US006736302B1

(12) United States Patent
Brownlee

(10) Patent No.: US 6,736,302 B1
(45) Date of Patent: May 18, 2004

(54) SHOULDER SUPPORTED SPORTS EQUIPMENT CARRIER

(76) Inventor: Walter Brownlee, 405 Hightstown La., Toms River, NJ (US) 08733

( * ) Notice: Subject to any disclaimer, the term of this patent is extended or adjusted under 35 U.S.C. 154(b) by 7 days.

(21) Appl. No.: 10/270,229

(22) Filed: Oct. 11, 2002

(51) Int. Cl.[7] ..... A45F 3/02

(52) U.S. Cl. ..... 224/607; 224/269; 224/615; 224/651; 224/652; 224/907; 224/919

(58) Field of Search ..... 224/269, 272, 224/602, 607, 615, 628, 651, 652, 907, 919; 206/315.1

(56) References Cited

U.S. PATENT DOCUMENTS 1,296,619 A * 3/1919 Bulat ..... 224/907
2,047,079 A * 7/1936 MacMurray ..... 206/315.5
3,610,490 A * 10/1971 Smith ..... 224/905
4,308,982 A * 1/1982 Hall ..... 224/607
4,693,402 A * 9/1987 Comeau ..... 224/919
4,790,460 A * 12/1988 Harper, Jr. ..... 224/907
5,131,576 A * 7/1992 Turnipseed ..... 224/628
5,176,303 A * 1/1993 Franke ..... 224/907
5,615,769 A * 4/1997 Stephenson ..... 224/919
6,196,437 B1 * 3/2001 Smith III ..... 224/628

* cited by examiner

*Primary Examiner*—Gary E. Elkins
(74) *Attorney, Agent, or Firm*—Goldstein Law Offices, P.C.

(57) ABSTRACT

A shoulder supported sporting equipment carrier for carrying a variety of sporting equipment, namely a baseball or softball bat, a glove, and a plurality of balls. The carrier has a base board, an adjustable shoulder strap, and fasteners for securing the sporting equipment on to the base board. A pocket may also be secured to the base board for holding balls.

6 Claims, 2 Drawing Sheets

SHOULDER SUPPORTED SPORTS EQUIPMENT CARRIER

BACKGROUND OF THE INVENTION

The invention relates to a shoulder supported sports equipment carrier. In particular, the invention is a sports equipment carrier that is adapted to be worn around a person's shoulder. The carrier supports pieces of sports equipment, namely a baseball or softball bat, a catcher's glove, and balls, for easy transport thereof.

Sports equipment, namely baseball and softball equipment, can often be cumbersome to carry. When going to practice or attending a game, it is necessary to bring a baseball or softball bat, a glove, and a number of balls. For children and adults traveling on a bicycle, it is difficult to carry all of the necessary equipment while trying to operate the bicycle. Even walking with all of the equipment can prove to be a difficult task.

In response to the above difficulties, many people opt to place all of the equipment in a bag for easier transport. However, if the person is walking or traveling by bicycle, carrying the bag can be awkward and heavy.

Thus, there exists a need for a shoulder supported sports equipment carrier that is adapted to be worn over a person's body. The carrier is constructed to hold various pieces of equipment, particularly baseball and softball equipment. Further, because of the positioning of the carrier on the user's body, the weight of the equipment is evenly distributed and much easier to transport.

U.S. Pat. No. 6,176,403 to Svare et al. discloses a sports utility belt that is worn around a player's waist. While the belt is capable of supporting a bat, the bat is held horizontally behind the player. This configuration creates a cumbersome and awkward carrying position.

U.S. Pat. No. 4,793,532 to Cash discloses a carrier for ballgame items, including bats and balls. The carrier has a vertically oriented housing that has an open top portion through which the bats and balls are inserted. However, this reference fails to provide for a means of securing the balls and bats in place within the housing.

U.S. Pat. No. 4,693,402 to Comeau discloses a sports pack that is worn on a user's back. The pack has a flexible sack portion adapted to receive balls and other equipment. However, Comeau also fails to secure the bat. Accordingly, the bat can easily slip out of its holder if the wearer leans forward, such as while riding a bicycle.

While these units may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved shoulder supported sports equipment carrier. As such, the general purpose of the present invention, which will be described subsequently in greater detail, is to provide a new and improved shoulder supported sports equipment carrier which has all the advantages of the prior art and none of the disadvantages.

To attain this, the present invention essentially comprises a shoulder supported sporting equipment carrier for carrying a variety of sporting equipment, namely a baseball or softball bat, a catcher's glove, and a plurality of balls. The carrier has a base board, an adjustable shoulder strap, and fasteners for securing the sporting equipment to the base board. A pocket may also be secured to the base board for holding balls.

It is an object of the invention to produce a shoulder supported sports equipment carrier that secures the equipment to the carrier during transport. Accordingly, the carrier has fasteners which secure the equipment, namely a bat and a gloves, in place on the board.

It is a further object of the invention to produce a shoulder supported sports equipment carrier that allows a user to easily carry sports equipment while walking or bicycle riding. Accordingly, the carrier has an adjustable shoulder strap that is adapted to be worn around the user. When in place, the base board rests on the user's back.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

| | |
|---|---|
| 10 | shoulder supported sporting equipment carrier |
| 12 | baseball bat |
| 14 | glove |
| 16 | ball |
| 18 | base board |
| 18F | base board front surface |
| 18R | base board rear surface |
| 18E | base board opposed ends |
| 20 | shoulder strap |
| 22 | fastener |
| 22B | bat fastener |
| 22G | glove fastener |
| 22P | pocket fastener |
| 23 | mating straps |
| 24 | pocket |
| 24S | pocket sealable edge |
| 26 | zipper |
| 28 | base board end slot |
| 30 | shoulder strap adjustment mechanism |
| 32 | shoulder strap pad |

DETAILED DESCRIPTION OF THE PREFERRED EMBODIMENTS

Figure 1:
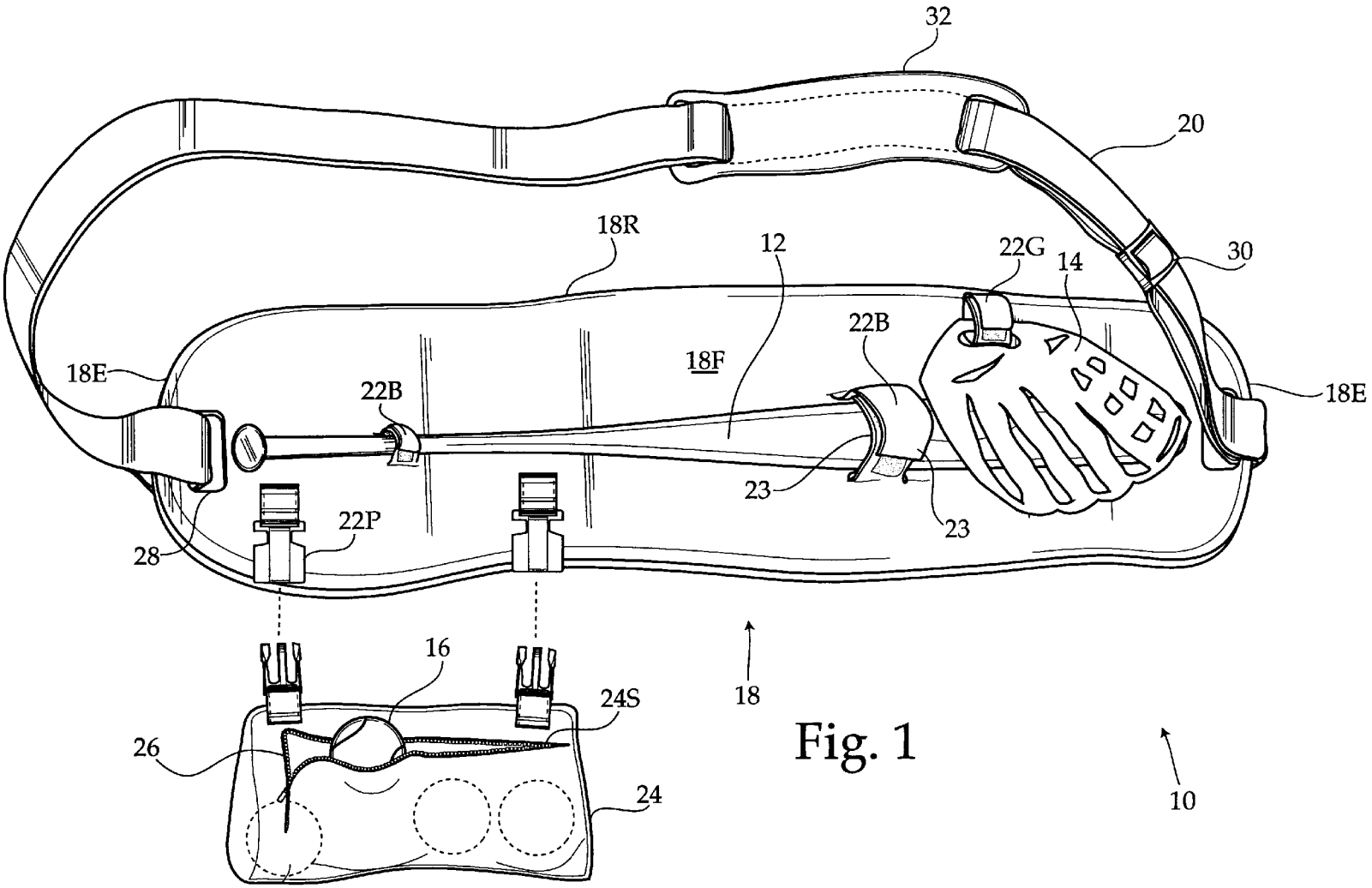
FIG. 1 is a perspective view of a shoulder supported sports equipment carrier.
Figure 2:
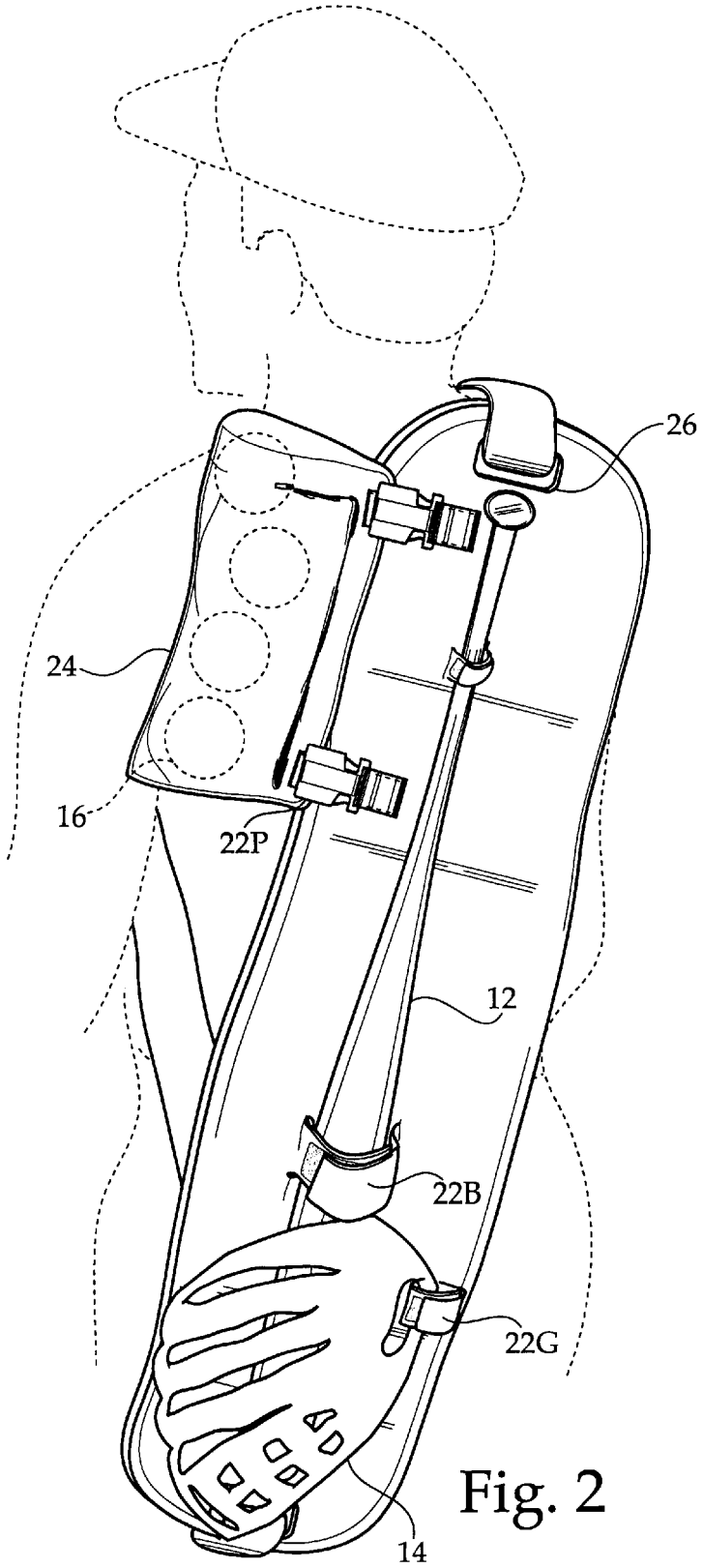
FIG. 2 is a perspective view of the carrier worn by a user.

FIG. 1 illustrates a shoulder supported sporting equipment carrier 10. The carrier 10 is capable of carrying a variety of sporting equipment, namely a baseball or softball bat 12, a catcher's glove 14, and a plurality of balls 16. The carrier 10 essentially comprises a base board 18, an adjustable shoulder strap 20, and a plurality of fasteners 22 for securing the sporting equipment to the base board 18.

The base board 18 has a front surface 18F, a rear surface 18R, and two opposed ends 18E. Each end 18E has a slot 28 for accommodating the shoulder strap 20, as will be discussed in greater detail hereinafter. The board 18 has an elongated length and is dimensioned to accommodate the length of a regulation baseball bat 12. When draped over a user's shoulder, the rear surface 18R of the base board 18 rests against the user's back and the board front surface 18F faces outward.

The sporting equipment is secured to the base board front surface 18F with the fasteners 22. While a variety of different fasteners 22 may be employed, opposed overlapping fastener straps 23 having hook and loop fasteners which together from a loop with the base board 18 are preferred because of the ease of fastening the same, as well as the adjustability of the loop size to accommodate various sized equipment. The fasteners 22 include a pair of bat fasteners 22B secured to the base board 18 near each opposed end 18E, the bat fastener 22B comprising two mateable fastener straps 23. The bat fasteners 22B are sized to fasten around the ends of the bat 12, thereby securing the bat 12 in place on the board 18. In addition, a glove fastener 22G is positioned on the board 18, said glove fastener 22G also comprising fastener strips 23 having mateable hook and loop fasteners. The glove fastener 22G is secured through an opening in the glove 14 to hold the glove on the back board 18. Lastly, pocket fasteners 22P are secured on either side of the bat fasteners 22B for selectively attaching a pocket 24 to the base board 18. The pocket 24 may be used to carry a variety of items, most typically balls 16. The pocket 24 has a selectively sealable edge 24S to provide access to the balls 16 therein. A zipper 26 may be used to seal the edge 24S to keep the balls 16 securely within the pocket 24 during transport. Referring to FIG. 1, the pocket fasteners 22P are illustrated as mating clasps. However, it should be noted that any suitable means of fastening may be employed.

The shoulder strap 20 is looped through the slots 28 at the opposed ends 18E of the base board 18. The strap 20 has an adjustment mechanism 30 for allowing the length of the strap 20 to be altered according to the size of the user. Further, a pad 32 is positioned along the strap 20 for cushioning and distributing the weight of the carrier 10 on the user's shoulder. The positioning of the padding 32 may be altered along the length of the strap 20, as necessary.

In use, the items of sporting equipment are secured to the base board 18 using the appropriate fasteners 22. The bat fasteners 22B are wrapped around the ends of the bat 12. The glove fastener 22G is mated with the glove 14. The balls 16 are placed in the pocket 24 and the pocket 24 is secured to the base board 18 by the pocket fasteners 22P. The carrier 10 is then slung over the user's shoulder and the length of the strap 20 is adjusted accordingly.

In conclusion, herein is presented a shoulder supported sporting equipment carrier. The invention is illustrated by example in the drawing figures, and throughout the written description. It should be understood that numerous variations are possible, while adhering to the inventive concept. Such variations are contemplated as being a part of the present invention.

What is claimed is:

1. A shoulder supported sporting equipment carrier for carrying a bat, a glove, and balls, comprising:

a shoulder strap;

a base board, the base board having a front surface, a rear surface, and two opposed ends, each end having a hole for accommodating the shoulder strap;

a plurality of fasteners for securing the sporting equipment to the front surface of the base board; and a pocket sized to fit a plurality of balls, the pocket having a sealable side for maintaining the balls therein, wherein the shoulder strap comprises an adjustment mechanism for altering the length of the strap and a pad portion for cushioning and distributing the weight of the carrier upon the user, and wherein the fasteners comprise a pair of bat fasteners for securing the bat to the base board, each bat fastener positioned near one of the base board opposed ends for holding the bat securely in place.

2. The shoulder supported sporting equipment carrier as recited in claim 1, wherein the fasteners comprise a glove fastener for securing the glove to the base board.

3. The shoulder supported sporting equipment carrier as recited in claim 2, wherein the fasteners comprise pocket fasteners for securing the pocket to the base board.

4. The shoulder supported sporting equipment carrier as recited in claim 3, wherein the base board has an elongated length to accommodate the length of the bat.

5. The shoulder supported sporting equipment carrier as recited in claim 4, wherein the fasteners are overlapping straps having hook and loop fasteners.

6. The shoulder supported sporting equipment carrier as recited in claim 4, wherein the fasteners are mating clasps.

* * * * *